US009837234B2

(12) United States Patent
Oh

(10) Patent No.: US 9,837,234 B2
(45) Date of Patent: Dec. 5, 2017

(54) INSTANT TRIP MECHANISM FOR MOLDED CASE CIRCUIT BREAKER

(71) Applicant: LSIS CO., LTD., Gyeonggi-do (KR)

(72) Inventor: Kihwan Oh, Gyeonggi-do (KR)

(73) Assignee: LSIS CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/379,280

(22) Filed: Dec. 14, 2016

(65) Prior Publication Data

US 2017/0243710 A1 Aug. 24, 2017

(30) Foreign Application Priority Data

Feb. 22, 2016 (KR) ..... 10-2016-0020786

(51) Int. Cl.

| | |
|---|---|
| ***H01H 71/74*** | (2006.01) |
| ***H01H 71/24*** | (2006.01) |
| ***H01H 71/02*** | (2006.01) |
| ***H01H 71/04*** | (2006.01) |
| ***H01H 71/08*** | (2006.01) |

(52) U.S. Cl.

CPC ..... *H01H 71/7463* (2013.01); *H01H 71/025* (2013.01); *H01H 71/04* (2013.01); *H01H 71/08* (2013.01); *H01H 71/2409* (2013.01)

(58) Field of Classification Search

CPC .. H01H 71/2409; H01H 71/025; H01H 71/04; H01H 71/08; H01H 71/7463; H01H 2071/7481

See application file for complete search history.

(56) References Cited

U.S. PATENT DOCUMENTS 2,920,161 A * 1/1960 Dessert ..... H01H 71/7463 200/404
3,110,848 A * 11/1963 Hobson, Jr. ..... H01H 71/40 335/273

(Continued)

FOREIGN PATENT DOCUMENTS

DE EP 1026719 A2 * 8/2000 ..... H01H 71/7463
JP 2002-237249 8/2002

(Continued)

OTHER PUBLICATIONS

Search Report from Korean Application No. 02-6915-6308 dated Oct. 8, 2015 (3 pgs).

*Primary Examiner* — Mohamad Musleh
(74) *Attorney, Agent, or Firm* — Knobbe, Martens, Olson & Bear, LLP

(57) ABSTRACT

Disclosed embodiments include an instant trip mechanism for a molded case circuit breaker. In some embodiments, the mechanism includes an adjustment dial to set a current for an instant trip operation; an instant bar provided with an upper portion contactable with the adjustment dial, a shaft portion serving as a rotation shaft, and a lower extending portion downwardly extending from the shaft portion; an electromagnet unit to generate a magnetic attraction force that is proportional to an amount of current flowing on the circuit; an armature rotatable with a lower end portion supported by a shaft, and attracted toward the electromagnet unit by the magnetic attraction force; and a spring for applying to the armature a load varying in a direction of the armature getting away from the electromagnet unit.

6 Claims, 10 Drawing Sheets

(56) References Cited

U.S. PATENT DOCUMENTS

| | | | | | |
|---|---|---|---|---|---|
| 3,181,041 | A * | 4/1965 | Falk | H01H 71/7463 | 335/176 |
| 3,213,248 | A * | 10/1965 | Leonard | H01F 27/40 | 335/17 |
| 4,197,519 | A * | 4/1980 | Grenier | H01H 71/0214 | 335/175 |
| 6,218,920 | B1 * | 4/2001 | Reichard | H01H 71/7463 | 335/172 |
| 8,558,650 | B2 | 10/2013 | Paek | | |
| 2011/0090031 | A1 | 4/2011 | Paek | | |

FOREIGN PATENT DOCUMENTS

| | | | | |
|---|---|---|---|---|
| JP | 2009-0123515 | | 6/2009 | |
| JP | 2013-045668 | | 3/2013 | |
| KR | GB 2441356 | A * | 3/2008 | H01H 71/7463 |
| KR | 10-0928936 | | 11/2009 | |
| KR | 100928936 | B1 | 11/2009 | |
| KR | 2010-0041570 | | 4/2010 | |
| KR | 10-1026306 | | 3/2011 | |
| KR | 101026306 | B1 | 3/2011 | |
| KR | 10-1206540 | | 11/2012 | |
| KR | 2014-0065010 | | 5/2014 | |
| KR | EP 2800122 | A1 * | 11/2014 | H01H 71/7463 |

* cited by examiner

INSTANT TRIP MECHANISM FOR MOLDED CASE CIRCUIT BREAKER

CROSS-REFERENCE TO RELATED APPLICATIONS

This application claims the benefit of Korean Application No. 10-2016-0020786, filed on Feb. 22, 2016, which is incorporated by reference herein in its entirety.

TECHNICAL FIELD

This disclosure relates to a molded case circuit breaker, and more particularly, an instant trip mechanism for a molded case circuit breaker, capable of reducing a fault current breaking time.

BACKGROUND

An instant trip mechanism for a molded case circuit breaker is an apparatus for detecting a fault current instantaneously, such as a short-circuit current several tens to hundreds times larger than a rated current, on an electric power circuit, and triggering a switching mechanism to perform a trip operation.

The following documents that have been applied by the present applicant may be taken into account as related art of the instant trip mechanism.

[Patent Document 1] KR10-0928936 B1

[Patent Document 2] KR10-1026306 B1

However, in the related art instant trip mechanisms when embodied as an electromagnet, in response to a fault current, perform a magnetic attraction at a position with the farthest distance from an armature, as a basic operation position, an operation time excessively extends, as compared with the operation performed a minimum set position with the shortest distance between the electromagnet and the armature, which causes increases in damages of the electric power circuit, an electric load and the molded case circuit breaker.

SUMMARY

Therefore, an aspect of some embodiments of the disclosure is to provide an instant trip mechanism for a molded case circuit breaker, capable of improving performance and reliability of the molded case circuit breaker, by reducing a fault current breaking time in a manner of shortening an operating distance of an armature which is attracted by an electromagnet upon a generation of a fault current.

To achieve these and other advantages and in accordance with the purpose of this disclosure, as embodied and broadly described herein, there is provided an instant trip mechanism for a molded case circuit breaker according to some embodiments, the mechanism comprising:

an adjustment dial to set a current for executing an instant trip operation;

an instant bar rotatable according to a contact position with the adjustment dial, and provided with an upper portion contactable with the adjustment dial, a shaft portion serving as a rotation shaft, and a lower extending portion downwardly extending from the shaft portion;

an electromagnet unit connected to a circuit to generate a magnetic attraction force that is proportional to an amount of current flowing on the circuit;

an armature rotatable with a lower end portion supported by a shaft, and attracted toward the electromagnet unit by the magnetic attraction force; and a spring including one end supported by the upper portion of the armature and another end supported by the lower extending portion of the instant bar, the spring applying to the armature a load varying in a direction of the armature getting away from the electromagnet unit.

According to one aspect of some embodiments of the present disclosure, the lower extending portion of the instant bar comprises a plurality of spring supporting recess portions with different heights from a lower end thereof to allow for varying the load of the spring.

According to another aspect of some embodiments of the present disclosure, the spring is configured so that the load of the spring is more reduced as a distance between the spring supporting recess portion and the upper portion of the armature is more shortened when a height of the spring supporting recess portion from the lower end of the lower extending portion is higher, under assumption that a height of the upper portion of the armature supporting one end of the spring is constant.

According to still another aspect of some embodiments of the present disclosure, a surface of the adjustment dial brought into contact with the upper portion of the instant bar is formed as a spiral surface, such that the adjustment dial adjusts the load of the spring by varying a rotation angle of the contacted instant bar.

According to still another aspect of some embodiments of the present disclosure, the spring is configured with a tensile spring charged with elastic energy in a tensile state.

According to still another aspect of some embodiments of the present disclosure, the adjustment dial comprises: an upper manipulation portion with a manipulation recess for manipulating the adjustment dial; a neck portion disposed beneath the upper manipulation portion and including a diameter smaller than that of the upper manipulation portion; and a spiral surface portion disposed beneath the neck portion and including a diameter greater than those of the upper manipulation portion and the neck portion, and brought into contact with the upper portion of the instant bar.

Further scope of applicability of the present application will become more apparent from the detailed description given hereinafter. However, it should be understood that the detailed description and specific examples, while indicating embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this disclosure, illustrate embodiments and together with the description serve to explain the principles of the disclosure.

In the drawings.

DETAILED DESCRIPTION

The aforementioned aspects of the present disclosure, a configuration of the present disclosure and operation effects of such configuration will be more obviously understood by the following description of the embodiments of the present disclosure with reference to the accompanying drawings.

Figure 1:
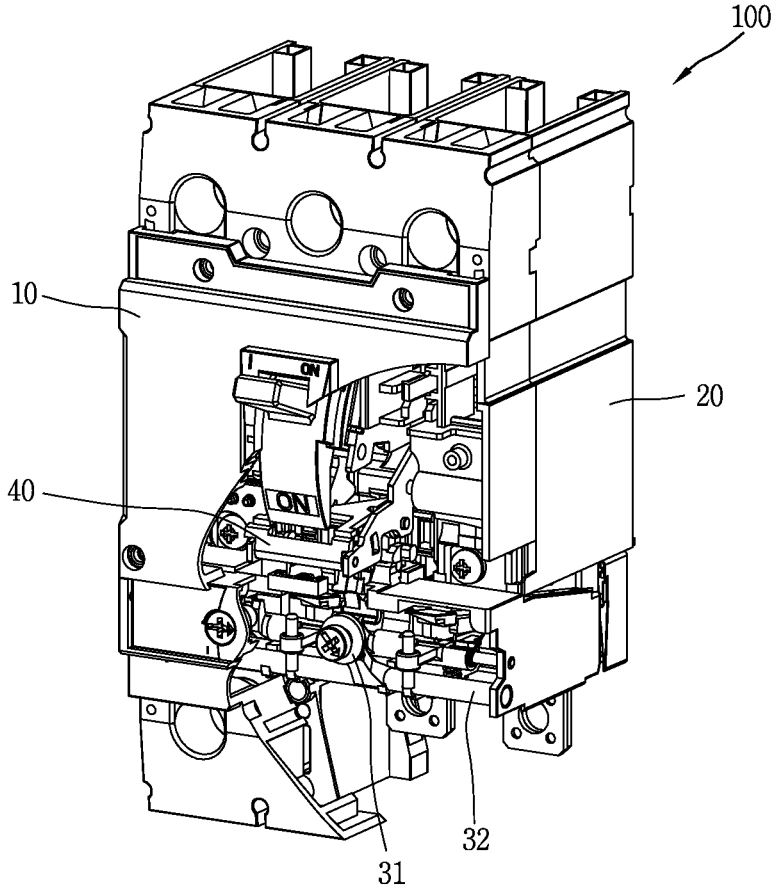
FIG. 1 is a partially-cut perspective view illustrating appearance and an internal structure of a molded case circuit breaker with an instant trip mechanism in accordance with some embodiments of the present disclosure.

FIG. 1 is a partially-cut perspective view illustrating appearance and an internal configuration of a molded case circuit breaker 100 in an ON state.

As illustrated in FIG. 1, the molded case circuit breaker 100 comprises an upper cover 10 and a lower case which construct an enclosure part.

In a partially-cut portion of FIG. 1 are viewed an adjustment dial 31, an instant bar 32 and a trip bar 40 which can be included in an instant trip mechanism. In a central portion of FIG. 1 are shown a manipulation handle (reference numeral not shown) set to an ON state and included in a switching mechanism 50 (see FIG. 4), the handle provides a means for manually turning on/off the molded case circuit breaker 100.

Hereinafter, description will be given of a configuration of an instant trip mechanism 30 of a molded case circuit breaker 100 in accordance with some embodiments of the present disclosure, with reference to FIGS. 2 to 6.

As illustrated, the instant trip mechanism 30 of the molded case circuit breaker in accordance with some embodiments comprises an adjustment dial 31, an instant bar 32, an electromagnet unit 37 (see FIGS. 5 and 6), an armature 33 (see FIGS. 5 and 6), and a spring 34.

The adjustment dial 31 provides a means for setting a current for executing an instant trip operation.

As illustrated in FIGS. 2 to 6 or FIGS. 9 and 10, the adjustment dial 31 is provided with a spiral surface 31*c*1 which is brought into contact with an upper portion 32*a* of the instant bar 32. The adjustment dial 31 may thus adjust a load of the spring 34 by varying a rotation angle of the instant bar 32.

Figure 9:
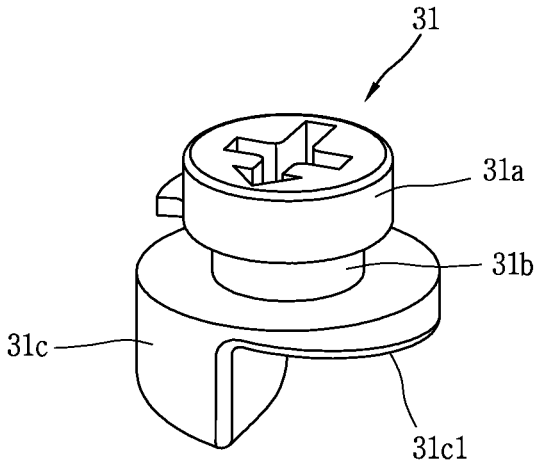
FIG. 9 is a top perspective view illustrating only an adjustment dial of the instant trip mechanism, viewed in an inclined direction in accordance with some embodiments of the present disclosure.
Figure 10:
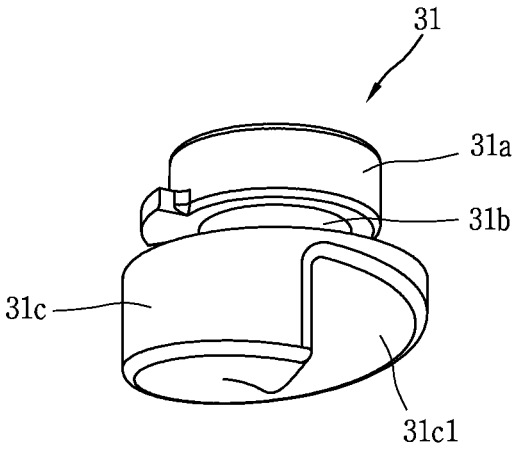
FIG. 10 is a bottom perspective view illustrating only the adjustment dial of the instant trip mechanism, viewed in an inclined direction in accordance with some embodiments of the present disclosure.

Specifically, as illustrated in FIGS. 9 and 10, the adjustment dial 31 comprises an upper manipulation portion 31*a*, a neck portion 31*b* and a spiral surface portion 31*c*.

The upper manipulation portion 31*a* is a portion which is exposed to outside of an upper cover 10 of the molded case circuit breaker 100 to allow for a user's access, and provided with a manipulation recess (cross recess according to some embodiments) for manipulating the adjustment dial 31.

The neck portion 31*b* is disposed beneath the upper manipulation portion 31*a* and smaller than the upper manipulation portion 31*a* in diameter.

The spiral surface portion 31*c* is disposed beneath the neck portion 31*b*, and includes a diameter greater than those of the upper manipulation portion 31*a* and the neck portion 31*b*. The spiral surface portion 31*c* is provided with a spiral surface 31*c*1 brought into contact with the upper portion 32*a* of the instant bar 31.

The instant bar 32, as illustrated in FIGS. 2 to 5, is rotatable in accordance with a position brought into contact with the adjustment dial 31.

Figure 11:
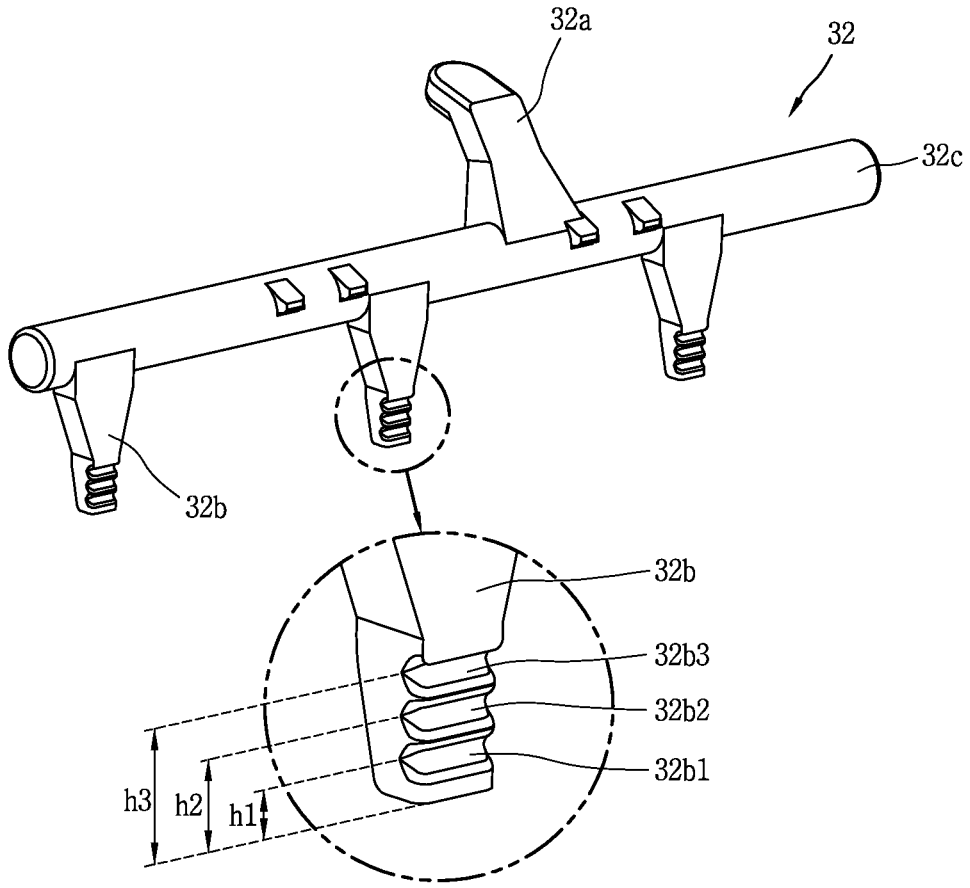
FIG. 11 is a perspective view illustrating a configuration of only an instant bar of the instant trip mechanism, wherein a drawing within a two-dot circle of FIG. 11 is a partially-enlarged perspective view illustrating a configuration of a lower extending portion of the instant bar, according to some embodiments of the present disclosure.

As well illustrated in FIG. 11, the instant bar 32 comprises a shaft portion 32*c*, an upper portion 32*a*, and lower extending portions 32*b*.

The shaft portion 32*c* is a portion serving as a rotation shaft, and formed long in a horizontal direction.

The upper portion 32*a* is a portion which upwardly extends from one position of the shaft portion 32*c* in a lengthwise direction of the shaft portion 32*c* to be contactable with the adjustment dial 31.

Since the upper portion 32*a* can be brought into contact with the adjustment dial 31, the one position of the shaft portion 32*c* in the lengthwise direction, on which a lower end portion of the upper portion 32*a* is located, can be determined to correspond to a position where the adjustment dial 31 is located in the horizontal direction on the upper cover 10 of FIG. 1.

The lower extending portion 32*b* is a portion downwardly extending from the shaft portion 32*c*. According to some embodiments, for a three-phases AC molded case circuit breaker, the lower extending portion 32*b* may be provided by three to correspond to three phases.

Each of the lower extending portions 32*b* comprises a plurality of spring supporting recess portions 32*b*1, 32*b*2 and 32*b*3 with different heights from a lower end thereof to change a load of the spring 34.

That is, the lower extending portion 32*b* comprises a first spring supporting recess portion 32*b*1 with a first height h1 which is the lowest height from the lower end, a second spring supporting recess portion 32*b*2 with a second height h2 as an intermediate height from the lower end, and a third spring supporting recess portion 32*b*3 with a third height h3 which is the highest height from the lower end.

Under assumption that an upper height of the armature 33, by which one end of the spring 34 is supported, is constant, when any one of the spring supporting recess portions 32*b*1, 32*b*2, 32*b*3 is higher from the lower end of the lower extending portion 32*b*, a distance from an upper portion of the armature 33 becomes shorter and thus the load of the spring 34 is reduced more.

According to the some embodiments, each of the lower extending portions 32*b* includes the three spring supporting recess portions 32*b*1, 32*b*2 and 32*b*3. However, according to varied embodiments, more or less spring supporting recess portions can be provided depending on a length of the lower extending portion 32*b*.

Figure 5:
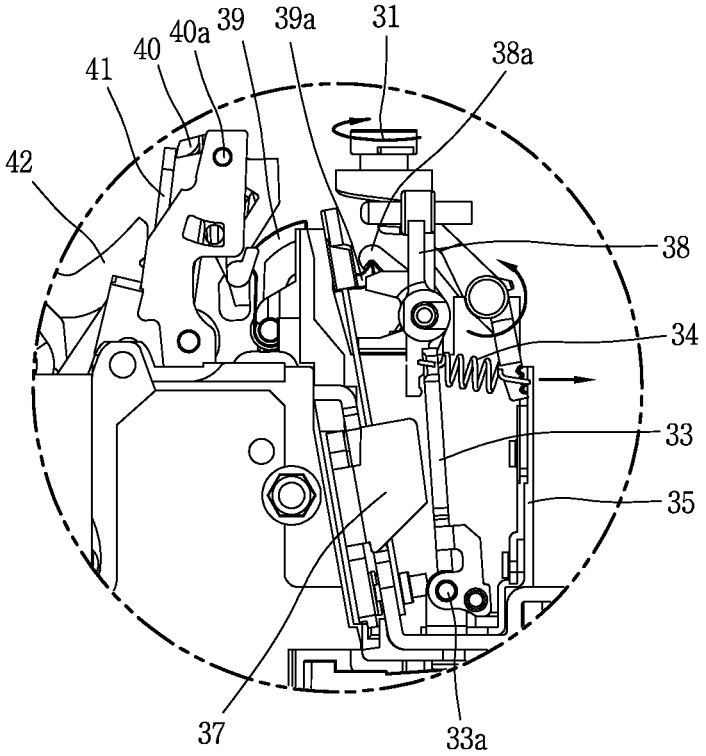
FIG. 5 is a partially-enlarged lateral view illustrating components of the instant trip mechanism in a state that the instant trip mechanism is set to operate with a maximum instant current in accordance with some embodiments of the present disclosure.
Figure 6:
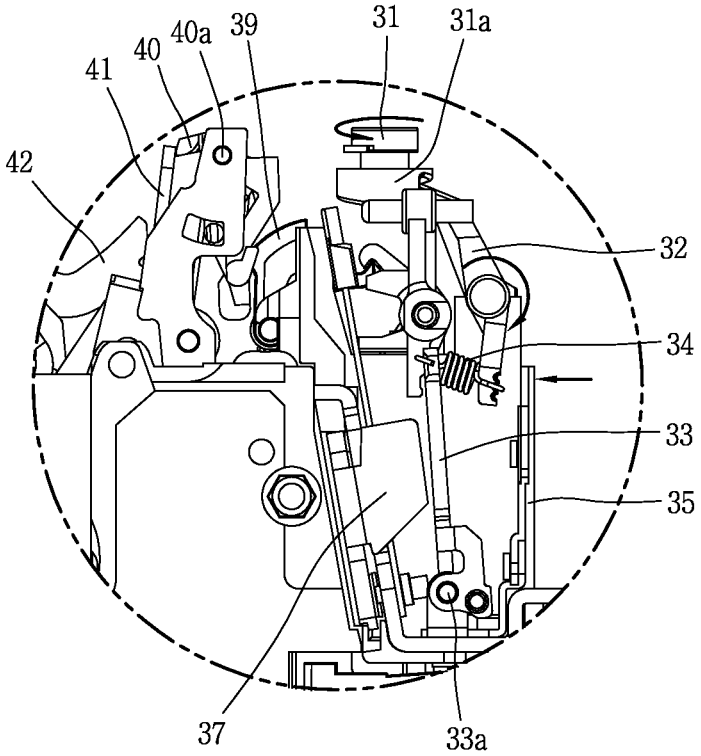
FIG. 6 is a partially-enlarged lateral view illustrating components of the instant trip mechanism in a state that the instant trip mechanism is set to operate with a minimum instant current in accordance with some embodiments of the present disclosure.

As illustrated in FIGS. 5 and 6, the electromagnet unit 37 is connected to three terminals of an electric power source side or an electric load side of the molded case circuit breaker 100, which can be connected to a three-phases AC circuit, respectively. Accordingly, the electromagnet unit 37 applies a magnetic attraction force, which is proportional to an amount of current flowing on the circuit, to the armature 33 installed to face the electromagnet unit 37.

Still referring to FIGS. 5 and 6, the armature 33 may be configured as an iron plate with a lower end portion rotatably supported by a rotation shaft 33*a*.

To support one end of the spring 34, the armature 33 comprises a spring supporting protrusion which upwardly protrudes into a narrow long shape such that one end of the spring is disposed and supported thereby. The spring supporting protrusion is also provided with a recess portion which is formed on a middle position thereof such that one end of the spring 34 is seated thereon.

The armature 33 can be attracted toward the electromagnet unit 37 by the magnetic attraction force.

A distance by which the armature 33 is spaced apart from the electromagnet unit 37 is irrespective of the manipulation of the adjustment dial 31.

In other words, even though a set value of an instant current (for example, instant trip current) is changed by rotating the adjustment dial 31, the spaced distance between the armature 33 and the electromagnet unit 37 is not changed.

As one end of the spring 34 is supported by the upper portion of the armature 33 and another end thereof is supported by the lower extending portion 32*b* of the instant bar 32, the spring 34 applies to the armature 33 a load that changes in a direction of the armature 33 getting away from the electromagnet unit 37 according to a position of the rotated lower extending portion 32*b*.

The spring 34 may be configured with a tension spring that is charged with elastic energy in a tensile state(that is "an extended state) according to some embodiments.

In FIGS. 5 and 6, a reference numeral 35 denotes a bimetal assembly as an assembly of a heater and a bimetal.

The instant trip mechanism for the molded case circuit breaker according to some embodiments can further comprise a cross bar 38, a trip shooter 39, and a trip bar 40.

The cross bar 38, as illustrated in FIGS. 2 to 6, comprises a rotation shaft portion, a hook portion 38*a* upwardly extending from the rotation shaft portion in an inclined manner by a predetermined angle to hook and stop the trip shooter 39, and a driving force receiving portion downwardly extending from the rotation shaft portion, and located on a moving track(locus) of the upper portion of the armature 33 to be pressed by the upper portion of the armature 33 and thus receive a driving force for rotation.

The rotation shaft portion of the cross bar 38 is a member in a bar(rod) shape which is long in a horizontal direction, and may receive an elastic force from a torsion spring (not illustrated) so as to be rotated in one direction (counterclockwise direction in FIGS. 5 and 6).

The hook portion 38*a* of the cross bar 38 is a portion by which a trip shooter 39 is hooked and stopped.

The driving force receiving portion of the cross bar 38 is rotated in a clockwise direction, in FIGS. 5 and 6, by receiving a pushing force applied by the upper portion of the armature 33, thereby causing a clockwise rotation of the cross bar 38.

The trip shooter 39 is a member which is rotatable centering on a rotation shaft (reference numeral not given). The trip shooter 39 comprises an upper extending portion extending upwardly from the rotation shaft and pushing the trip bar 40 to rotate, and a latch portion 39*a* extending in a lateral direction (to right in the drawing) from the upper extending portion toward the hook portion 38*a* of the cross bar 38.

The rotation shaft of the trip shooter 39 can receive an elastic force from a torsion spring (not illustrated) to be rotated in one direction (counterclockwise direction in FIGS. 5 and 6).

The trip bar 40 is a member rotatable centering on a rotation shaft 40*a*. The trip bar 40 is rotated in a clockwise direction, in FIGS. 5 and 6, when being pressed by the upper extending portion of the trip shooter 39.

Also, the trip bar 40 can be provided as a member which locks or releases a latch holder 41 which is comprised in a switching mechanism 50.

The latch holder 41 can be provided as a means which locks or releases a latch 42 comprised in the switching mechanism 50.

When the trip bar 40 rotates in the clockwise direction in FIGS. 5 and 6, the latch holder 41 which was elastically pressed by a spring (not illustrated) rotates in the clockwise direction.

When the latch holder 41 rotates in the clockwise direction, the latch 42 is released. Accordingly, a trip operation (for example, an automatic circuit breaking operation) that a movable contact is separated from a corresponding fixed contact by the switching mechanism 50 is achieved.

Hereinafter, an operation of the instant trip mechanism for the molded case circuit breaker according to some embodiments including such configuration will be described with reference to FIGS. 2 to 8.

First, an instant current setting operation of the instant trip mechanism for the molded case circuit breaker according to some embodiments will be described.

Figure 2:
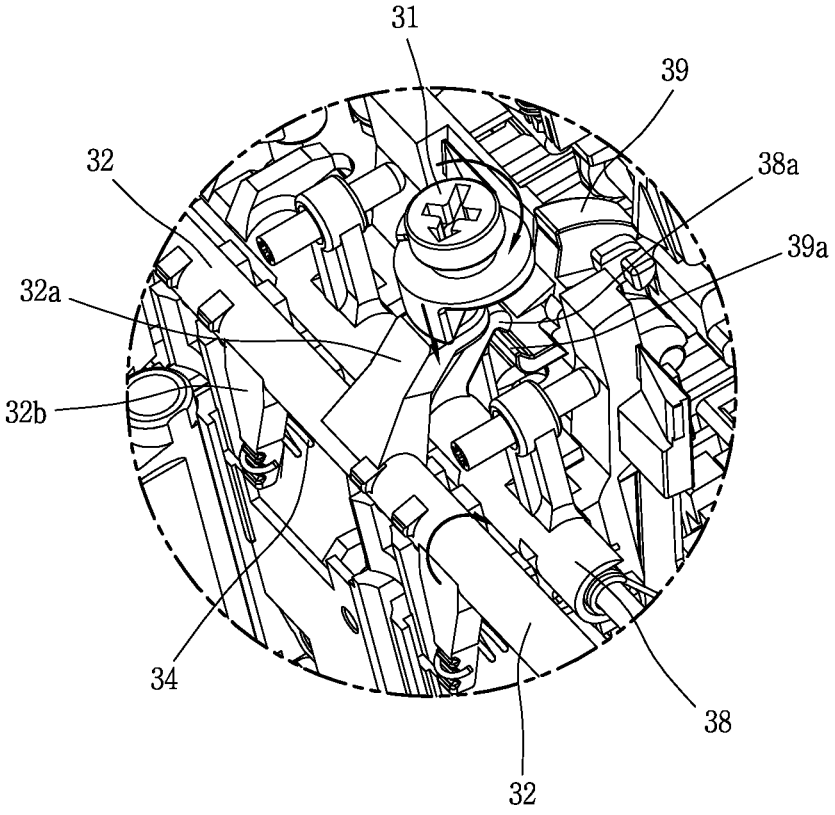
FIG. 2 is a partially enlarged view illustrating an operating state of a main part of the instant trip mechanism in a state that the instant trip mechanism is set to operate with a maximum instant current in accordance with some embodiments of the present disclosure.
Figure 3:
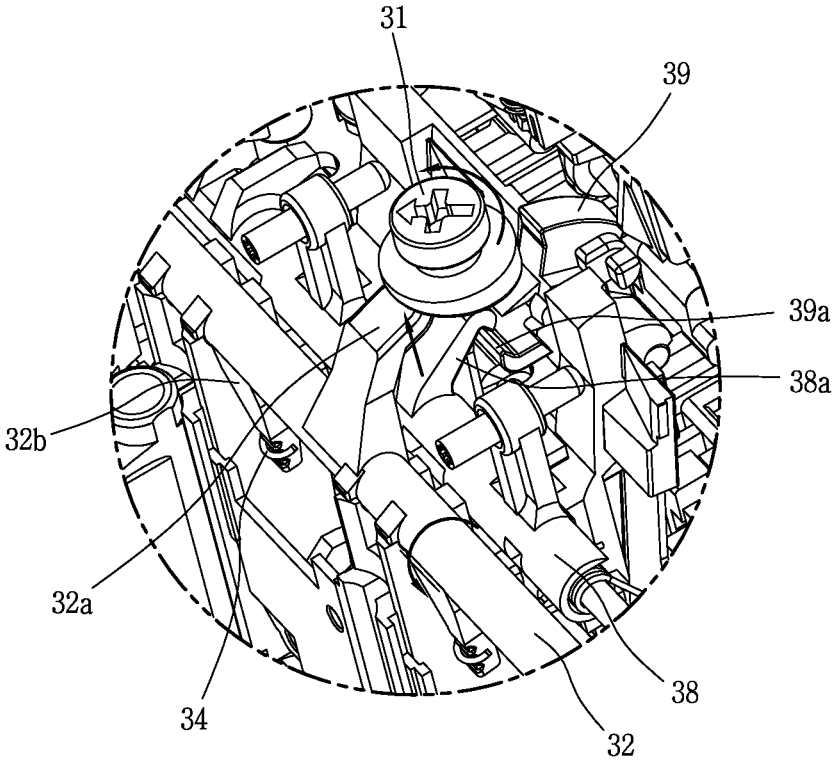
FIG. 3 a partially enlarged view illustrating an operating state of a main part of the instant trip mechanism in a state that the instant trip mechanism is set to operate with a minimum instant current in accordance with some embodiments of the present disclosure.

As illustrated in FIG. 2 or 5, a screw driver is connected to the upper manipulation portion 31*a* (see FIG. 9) of the adjustment dial 31 to rotate the adjustment dial 31 in a clockwise direction (direction indicating with a curved arrow) up to a maximum limit (for example, an instant current is set to a maximum value).

The upper portion 32*a* of the instant bar 32 is then pressed down by a lower surface of the adjustment dial 31, and, as illustrated in FIG. 5, rotated in a counterclockwise direction accordingly.

Also, one end of the spring 34 is fixed by the upper end portion of the armature 33 but another end (right end in FIG. 5) of the spring 34 is moved to right in the drawing, in response to the counterclockwise rotation of the instant bar 32. Therefore, the spring 34 extends and a load applied to the armature 33 is increased up to the maximum.

Accordingly, the armature 33 is attracted toward the electromagnet unit 37 only when the electromagnet unit 37 supplies (generates) a magnetic attraction force, which is great enough to bear the maximum load, in response to a great instant current flowing on a circuit.

Figure 4:
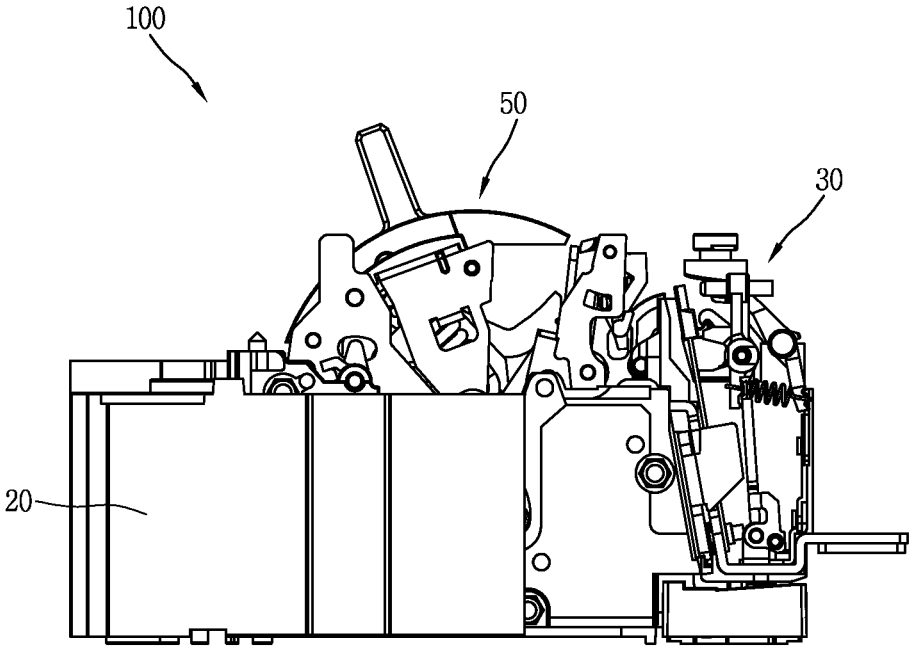
FIG. 4 is a partially-cut lateral view illustrating the molded case circuit breaker in an ON state and the instant trip mechanism according to some embodiments of the present disclosure.

In this instance, the molded case circuit breaker is in a state as illustrated in FIG. 4. That is, a manipulation handle included in the switching mechanism 50 indicates an ON position and is in a state rotated to left in FIG. 4. Also, the state of the instant trip mechanism 30 is as shown in FIG. 4.

As illustrated in FIGS. 3 to 6, a screw driver is inserted into the upper manipulation portion 31*a* (see FIG. 9) of the adjustment dial 31 to rotate the adjustment dial 31 in a counterclockwise direction (direction indicating with a curved arrow) up to a maximum limit (for example, an instant current is set to a minimum value).

The upper portion 32*a* of the instant bar 32 is raised up along the spiral surface 31*c*1 of the adjustment dial 31, and, as illustrated in FIG. 6, rotated in a clockwise direction accordingly.

Also, one end of the spring 34 is fixed by the upper end portion of the armature 33 but another end (right end in FIG. 5) of the spring 34 is moved to left in the drawing, in response to the clockwise rotation of the instant bar 32. Therefore, the spring 34 is shrunk and a load applied to the armature 33 is decreased down to the minimum.

Accordingly, the armature 33 can be attracted toward the electromagnet unit 37 when the electromagnet unit 37 supplies a magnetic attraction force, which is great enough to bear the minimum load, in response to a current flowing on a circuit.

Figure 7:
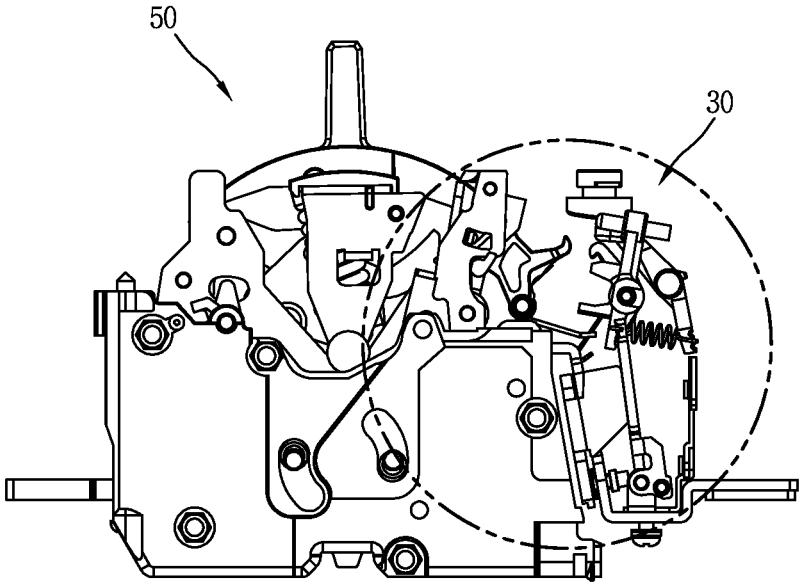
FIG. 7 is a lateral view illustrating operating states of the instant trip mechanism and a switching mechanism in a trip state, according to some embodiments of the present disclosure.

Hereinafter, an operation of the instant trip mechanism for the molded case circuit breaker according to some embodiments of the present disclosure upon a trip operation will be described with reference to FIGS. 7 and 8.

When a great fault current, such as a short-circuit current as large as several times to several ten times of a rated current, flows on an electric power circuit, to which the molded case circuit breaker is connected, the fault current magnetizes the electromagnet unit 37 to generate a great magnetic attraction force.

Figure 8:
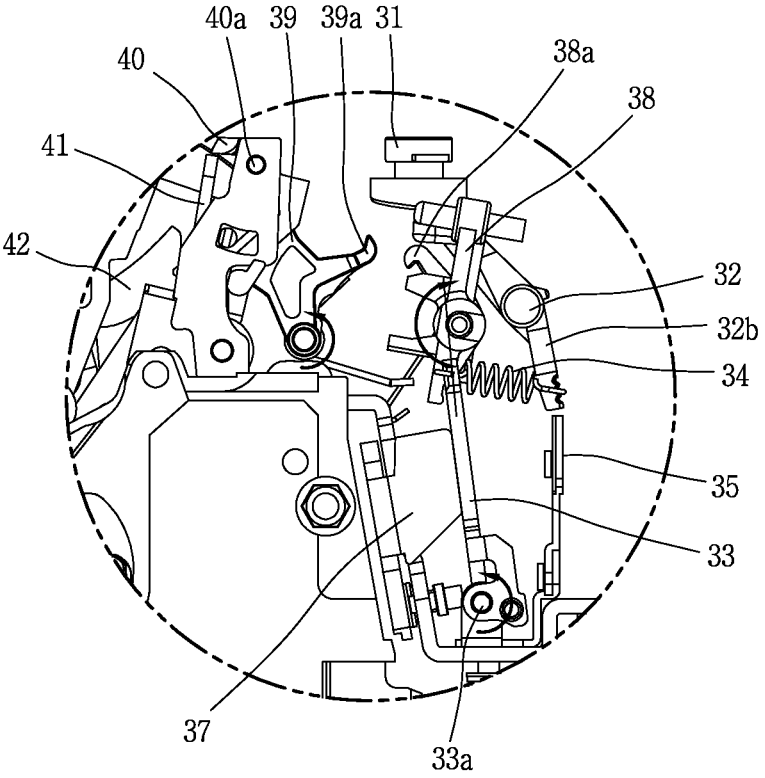
FIG. 8 is a partially-enlarged view illustrating an operating state of the instant trip mechanism illustrated in FIG. 7, according to some embodiments of the present disclosure.

Accordingly, the armature 33 is attracted toward the electromagnet unit 37 by the great attractive force of the electromagnet unit 37, and rotated from a state illustrated in FIG. 5 or 6 in a counterclockwise direction centering on the rotation shaft 33*a* into a state illustrated in FIG. 8.

The cross bar 38 is pressed by the upper portion of the armature 33 rotated in the counterclockwise direction and thus rotated in a clockwise direction in the drawing.

Therefore, the hook portion 38*a* of the cross bar 38 releases the latch portion 39*a* and the trip shooter 39 is accordingly rotated in the counterclockwise direction in the drawing.

The trip bar 40 is then pressed by the upper extending portion of the trip shooter 39, thereby being rotated in the counterclockwise direction centering on the rotation shaft 40*a*.

Accordingly, the latch holder 41 which was locked by the trip bar 40 is released and elastically pressed by a spring (not illustrated), thereby being rotated in the clockwise direction.

When the latch holder 41 is rotated in the clockwise direction, the latch 42 is released. Accordingly, a trip operation (for example, an automatic circuit breaking operation) that a movable contact is separated from a corresponding fixed contact by the switching mechanism 50 is achieved.

That is, when the latch 42 is released, the movable contact, which is supported by a shaft according to an interlocking between a link and the shaft, is separated from the corresponding fixed contactor by elastic energy of a trip spring (not illustrated) included in the switching mechanism 50, thereby enabling the trip operation (automatic circuit breaking operation).

Here, the configuration and detailed operations of the switching mechanism are well known, so detailed description thereof will be omitted.

An instant trip mechanism for a molded case circuit breaker according to some embodiments of the present disclosure comprises an armature with a spaced distance from an electromagnet unit, which does not affect a manipulation of an adjustment dial, and a spring including one end supported by an upper portion of the armature and another end supported by a lower extending portion of an instant bar, and applying to the armature a load, which is changed in a direction of the armature getting away from the electromagnet unit according to a position of the rotated lower extending portion. Therefore, when a fault current is generated on an electric power circuit in an initial state that the electromagnet and the armature are not excessively spaced apart from each other, the molded circuit breaker can fast execute a trip operation owing to a short moving distance of the armature. This may result in improving an instant trip performance and reliability of the molded case circuit breaker.

In the instant trip mechanism for the molded case circuit breaker according to some embodiments of the present disclosure, the lower extending portion of the instant bar comprises a plurality of spring supporting recesses with different heights from a lower end thereof. Accordingly, setting of an instant current can be adjusted by varying a load of the spring in response to a selection of one of the spring supporting recesses.

In the instant trip mechanism for the molded case circuit breaker according to some embodiments of the present disclosure, under assumption that an upper height of the armature, by which one end of the spring is supported, is constant, when the spring supporting recess is higher from the lower end of the lower extending portion, a distance from the upper portion of the armature can be shorter, thereby more reducing the load of the spring.

In the instant trip mechanism for the molded case circuit breaker according to some embodiments of the present disclosure, the adjustment dial may be provided with a spiral surface which is brought into contact with the upper portion of the instant bar. Therefore, a rotation angle of the instant bar varies according to a contact position with the spiral surface, thereby adjusting the load of the spring.

In the instant trip mechanism for the molded case circuit breaker according to some embodiments of the present disclosure, the spring can be configured with a tension spring which is charged with elastic energy in a tensile state. Therefore, the elastic energy charged in the spring can vary by varying an extended length of the spring according to the position of the lower extending portion of the instant bar, thereby varying an elastic load applied by the spring to the armature.

In the instant trip mechanism for the molded case circuit breaker according to some embodiments of the present disclosure, the adjustment dial may comprise an upper manipulation portion with a manipulation recess for manipulating the adjustment dial, a neck portion disposed beneath the upper manipulation portion and including a diameter smaller than that of the upper manipulation portion, and a spiral surface portion disposed beneath the neck portion, including a diameter greater than those of the upper manipulation portion and the neck portion, and brought into contact with the upper portion of the instant bar. Therefore, a screw driver can be connected to the manipulation recess to enable setting of an instant current. Also, the rotation angle of the instant bar can change according to a position where the spiral surface portion is brought into contact with the upper portion of the instant bar, thereby adjusting the load of the spring. The features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. An instant trip mechanism for a molded case circuit breaker, the mechanism comprising:

an adjustment dial configured to set a current for executing an instant trip operation;

an instant bar configured to be rotatable according to a contact position with the adjustment dial, and including an upper portion contactable with the adjustment dial, a shaft portion serving as a rotation shaft, and a lower extending portion downwardly extending from the shaft portion;

an electromagnet unit configured to be connected to a circuit to generate a magnetic attraction force that is proportional to an amount of current flowing on the circuit;

an armature configured to be rotatable with a lower end portion supported by a shaft, and attracted toward the electromagnet unit by the magnetic attraction force; and a spring including one end supported by an upper portion of the armature and another end supported by the lower extending portion of the instant bar, the spring configured to apply to the armature a load varying in a direction of the armature getting away from the electromagnet unit.

2. The mechanism of claim 1, wherein the lower extending portion of the instant bar comprises a plurality of spring supporting recess portions with different heights from a lower end thereof to allow for varying the load of the spring.

3. The mechanism of claim 2, wherein the load of the spring is reduced as a distance between the spring supporting recess portion and the upper portion of the armature is shortened when a height of the spring supporting recess portion from the lower end of the lower extending portion is higher, under assumption that a height of the upper portion of the armature supporting one end of the spring is constant.

4. The mechanism of claim 1, wherein a surface of the adjustment dial brought into contact with the upper portion of the instant bar is formed as a spiral surface, such that the adjustment dial adjusts the load of the spring by varying a rotation angle of the contacted instant bar.

5. The mechanism of claim 1, wherein the spring is configured with a tensile spring charged with elastic energy in a tensile state.

6. The mechanism of claim 1, wherein the adjustment dial comprises:

an upper manipulation portion with a manipulation recess configured to manipulate the adjustment dial;

a neck portion disposed beneath the upper manipulation portion and including a diameter smaller than that of the upper manipulation portion; and a spiral surface portion disposed beneath the neck portion and including a diameter greater than those of the upper manipulation portion and the neck portion, and configured to be brought into contact with the upper portion of the instant bar.

* * * * *